US006318067B1

(12) United States Patent
Marquard

(10) Patent No.: US 6,318,067 B1
(45) Date of Patent: Nov. 20, 2001

(54) INTERNAL COMBUSTION ENGINE WITH BALANCED ROTARY COMBUSTION CHAMBER SEPARATE FROM RECIPROCATING POWER CYLINDER

(76) Inventor: Michael M. Marquard, 812 Oak Tree Rd., Kennett Square, PA (US) 19348

( * ) Notice: Subject to any disclaimer, the term of this patent is extended or adjusted under 35 U.S.C. 154(b) by 0 days.

(21) Appl. No.: 09/483,544

(22) Filed: Jan. 14, 2000

(51) Int. Cl.[7] ..... F02G 3/02
(52) U.S. Cl. ..... 60/39.6
(58) Field of Search ..... 60/39.6; 123/222, 123/41.49, 41.65

(56) References Cited

U.S. PATENT DOCUMENTS

| | | | | |
|---|---|---|---|---|
| 709,030 | * | 9/1902 | McCahon | 123/222 |
| 891,820 | * | 6/1908 | Cruyt | 60/39.6 |
| 1,004,696 | | 10/1911 | Schoeck . | |
| 1,078,168 | | 11/1913 | Ruhlmann . | |
| 3,651,641 | * | 3/1972 | Ginter | 60/39.6 |
| 3,811,271 | | 5/1974 | Sprain | 60/39.6 |
| 3,921,595 | | 11/1975 | Saunders . | |
| 3,931,807 | | 1/1976 | Bloom . | |
| 3,932,987 | | 1/1976 | Munzinger | 60/39.52 |
| 4,181,172 | * | 1/1980 | Longhouse | 123/41.49 |
| 4,241,713 | | 12/1980 | Crutchfield | 123/202 |
| 4,393,828 | | 7/1983 | Jolly | 123/203 |
| 4,396,351 | * | 8/1983 | Hayashi et al. | 123/41.49 |
| 4,646,693 | | 3/1987 | Fayngersh et al. | 123/238 |
| 4,655,686 | * | 4/1987 | Nonnenmann et al. | 123/41.49 |
| 4,662,329 | | 5/1987 | Roggenburk | 123/236 |
| 4,696,268 | | 9/1987 | Zimmermann | 123/203 |
| 4,739,615 | * | 4/1988 | Staheli | 60/39.6 |
| 4,815,275 | | 3/1989 | Eickmann | 60/39.6 |
| 5,241,816 | | 9/1993 | Drnevich | 60/39.53 |
| 5,247,916 | * | 9/1993 | Riney | 123/222 |
| 5,375,564 | | 12/1994 | Gail | 123/44 |
| 5,522,356 | | 6/1996 | Palmer | 123/236 |
| 5,946,903 | | 9/1999 | Marquard | 60/39.6 |

OTHER PUBLICATIONS

R. F. Ansdale; "The Wankel RC Engine Design and Performance"; 1968; cover; contents page; pp. 4 through 19.

* cited by examiner

*Primary Examiner*—Michael Koczo
(74) *Attorney, Agent, or Firm*—Ratner & Prestia

(57) ABSTRACT

An internal combustion engine for driving a power shaft, the engine comprising a cylindrical rotor rotatably mounted between opposing faceplates and adapted to rotate about a rotor axis. The rotor comprises a plurality of fixed volume fuel ignition compartments, each fuel ignition compartment defined circumferentially by a cylindrical sidewall of the rotor and by a central hub, and defined radially by radial vanes of the rotor. Each radial vane is connected to the sidewall at one end and to the central hub at an opposite end. The fuel ignition compartments are closed axially by the opposite faceplates. At least one of the faceplates comprises a gas exhaust port. A power cylinder, comprising a reciprocating piston therein and an exhaust valve, is in direct gas communication with the gas exhaust port. For a two-cylinder engine, each fuel ignition compartment further comprises a pair of symmetrical axial blocking plates extending between the radial vanes parallel to and in contact with the faceplates. The blocking plates extend either radially outward from the hub or radially inward from the rotor circumferential sidewall a distance sufficient to block the exhaust port on one of the opposing faceplates. The invention also comprises the above-described rotor individually, without the other components of the engine.

22 Claims, 3 Drawing Sheets

INTERNAL COMBUSTION ENGINE WITH BALANCED ROTARY COMBUSTION CHAMBER SEPARATE FROM RECIPROCATING POWER CYLINDER

TECHNICAL FIELD

This invention relates to internal combustion engines and more particularly to an internal combustion engine having a separate rotary combustion chamber venting into an associated reciprocating power cylinder.

BACKGROUND OF THE INVENTION

Rotary and reciprocating internal combustion engines are well-known in the art. For example, the Wankel rotary engine typically comprises a combustion chamber with a rotor rotating therein. The rotor is connected to a power shaft extending outside the combustion chamber. The rotor shape is generally triangular and the three triangle apexes ride against the inner surface of the compression chamber, creating three chambers defined between the inner surface of the compression chamber and the faces of the triangular rotor. A proper mixture of fuel and air is injected to the chamber at a point where the chamber volume is the largest. As the rotor rotates and the chamber volume decreases, the fuel/air mixture is compressed. Ignition is initiated at the point of maximum compression, which is typically at the point where the chamber volume is at a minimum. The rotor and combustion chamber design is selected such that the force of the expanding gasses due to the ignition of the fuel turns the rotor, which turns the power shaft, which then provides power where desired.

Reciprocating engines typically comprise a plurality of stationary discreet combustion cylinders, each of which contains a reciprocating piston. As the piston travels in a first (traditionally referred to as the "up") direction, the cell volume in the space between the top of the piston and the cylinder decreases until the cylinder reaches the upper limit of its travel. A proper combustible mixture of fuel and air is introduced at the time when the piston is at its lowermost position. The combustible mixture is compressed as the piston travels upwardly and ignition is initiated at the point of maximum compression. The ignited combustible mixture produces an expanding volume of hot gas that pushes the cylinder downwardly as it expands.

Reciprocating engines have further evolved into two more subcategories, widely known as two-cycle and four-cycle. In a two-cycle engine the exhausting of the spent hot gases and the intake of the combustible mixture occur during the same travel of the piston, whereas in the four-cycle these steps occur in two distinct travels of the piston. Therefore, the two-cycle engine provides a power stroke every time the piston moves to its uppermost position whereas the four-cycle engine provides a power stroke every other time the piston moves to its uppermost position.

Both types of engines described above may have a fundamental limitation in efficiency related to the fact that because the combustion and expansion volumes are the same, the full potential power output of the hot combustion gas byproducts cannot be recovered. For example, in a reciprocating engine having a ten to one compression ratio, the combustible mixture undergoes a ten to one compression ratio. Likewise, decompression of the hot exhaust is limited to a ten to one volume change, since the compression volume is the same as the decompression volume. Therefore, the full work output of the expanding gasses is not recaptured, because as soon as the piston reaches the bottom of its travel it starts moving upwardly and pushes against the still-expanding hot gas. At this time the exhaust port in the cylinder is opened, relieving the pressure and allowing the gas to exhaust. Thus, in standard engines, energy is lost both in stopping the gas expansion and in working against the still expanding gasses in the process of expelling them.

U.S. Pat. No. 5,946,903 (hereinafter "the '903 Patent), granted to the inventor of the present invention and incorporated herein by reference, discloses an internal combustion engine that provides increased efficiency by overcoming the above limitation. In particular, the '903 patent discloses an engine wherein the rotary combustion chamber is separated from the reciprocating piston in the power cylinder. The separation enables the exhaust gas in the piston to fully decompress without being limited by the size of the combustion chamber. The rotor described in the '903 patent, in particular, included a plurality of telescoping partitioning vanes extending radially from the core to provided the compression of the fuel/air mixture prior to ignition. Not all engines, however, necessarily require mechanical compression of the fuel/air mixture in the combustion chamber.

In standard rotary combustion engines, including the engine described the '903 Patent, the combustion chamber in the rotor is typically defined by the walls of the rotor, a fixed circumferential sidewall, a fixed top, and a fixed bottom. Thus, the exploding gases contained in the chamber exert a force against the walls of the rotor, tending to push the rotor away from the circumferential sidewall. This explosion force may push the opposite side of the rotor into the circumferential sidewall on the opposite side of the rotor (or, in the case of the rotor disclosed in the '903 Patent, the explosion force may push the rotor shaft into the bearing) causing friction and wear.

It is an object of the present invention to provide an internal combustion engine that takes advantage of a separation between the combustion chamber and the power cylinder to reduce friction and wear as compared to standard rotors.

SUMMARY OF THE INVENTION

The present invention comprises an internal combustion engine, the engine comprising a cylindrical rotor rotatably mounted between opposing faceplates and adapted to rotate about a rotor axis. The rotor comprises a plurality of compartments, each compartment defined circumferentially by a cylindrical sidewall of the rotor and by a central hub, and defined radially by radial vanes of the rotor. Each radial vane is connected to the sidewall at one end and to the central hub at an opposite end. The compartments are closed axially by the opposite faceplates. At least one of the faceplates comprises a gas exhaust port. A power cylinder, comprising a reciprocating piston therein and an exhaust valve, is in direct gas communication with the gas exhaust port.

The power cylinder exhaust valve may further comprise a valve adapted to close when gas pressure inside the power cylinder exceeds atmospheric pressure and to open when the atmospheric pressure exceeds the gas pressure inside the power cylinder. The exhaust valve may further comprise a valve stem and the rotor may be connected to a rotor shaft comprising a cam adapted to actuate the valve stem to forceably open the power cylinder exhaust valve during an exhaust cycle of the power cylinder.

The engine may have two cylinders and each faceplate may comprise a gas exhaust port such that each cylinder is in gas communication with one of the exhaust ports. In particular, the exhaust port on one faceplate may be radially more distant from the rotor axis than the other exhaust port. Each compartment of the rotor may then further comprise a pair of symmetrical axial blocking plates extending between the radial vanes parallel to and in contact with the faceplates, the blocking plates extending either radially outward from the hub or radially inward from the rotor circumferential sidewall. The radial extension of the blocking plates is sufficient to block the exhaust port on one of the opposing faceplates to prevent gas discharge from the compartment therethrough.

The invention also comprises the above-described rotor individually, without the other components of the engine.

DETAILED DESCRIPTION OF THE INVENTION

Figure 1:
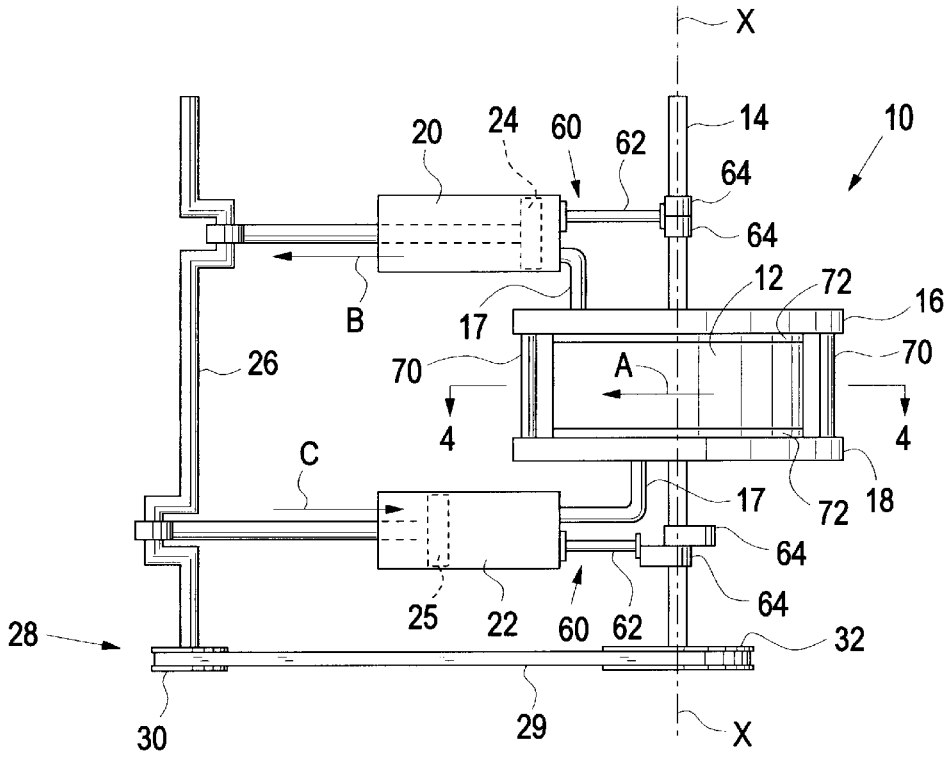
FIG. 1 is a schematic diagram of an exemplary engine of the present invention.

The invention will next be described with reference to the figures, which are schematic drawings in nature, and are provided for purposes of illustration rather than limitation. A number of simplifications and omissions are present in the drawings, for example, but not limited to: elements of construction such as intake and exhaust valves and ports, details of the conversion of reciprocating motion to rotary motion, flywheel mounting, mountings and supports for the combustion and power cylinders and associated elements, and the like. Such features, while being essential for the actual assembly and use of an internal combustion engine, are elements well known in the art and are such that the selection of any particular element is of no particular significance to the practice of this invention. Similarly, elements such as fuel supply piping, fuel storage tanks, and fuel injector details have also been omitted for the same reason, since their representation in the figures would unduly clutter them and would unnecessarily complicate the description and understanding of the present invention.

Figure 2:
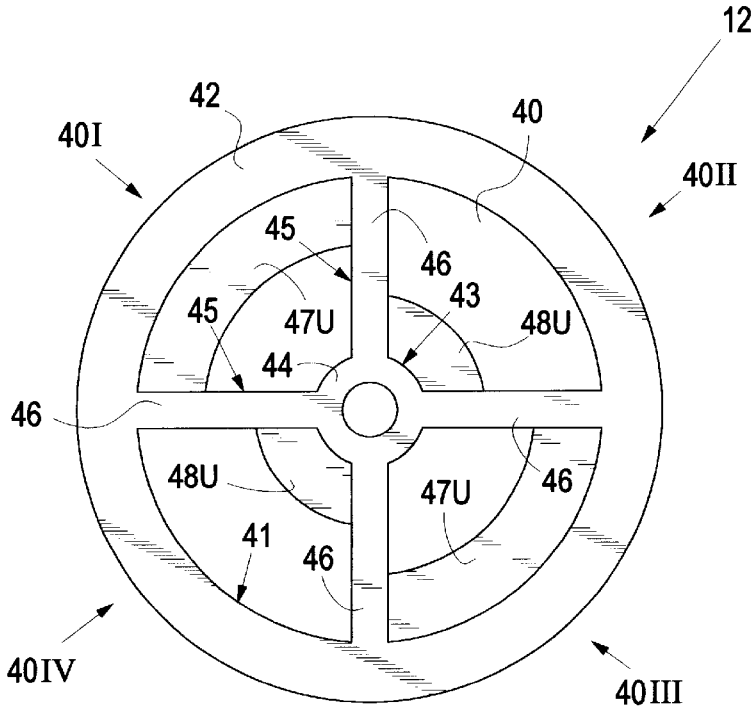
FIG. 2 is a detailed top view of the exemplary rotor shown in FIG. 1.
Figure 3:
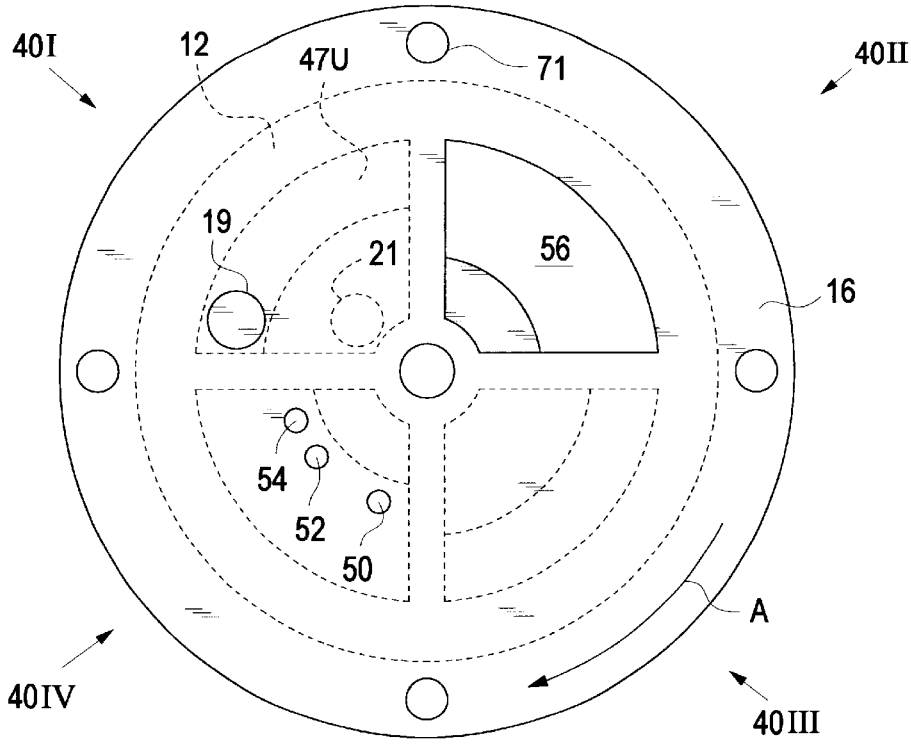
FIG. 3 is a detailed top view of the exemplary upper faceplate shown in FIG. 1, showing the relationship of features of the hidden, underlying rotor in dashed lines.
Figure 4:
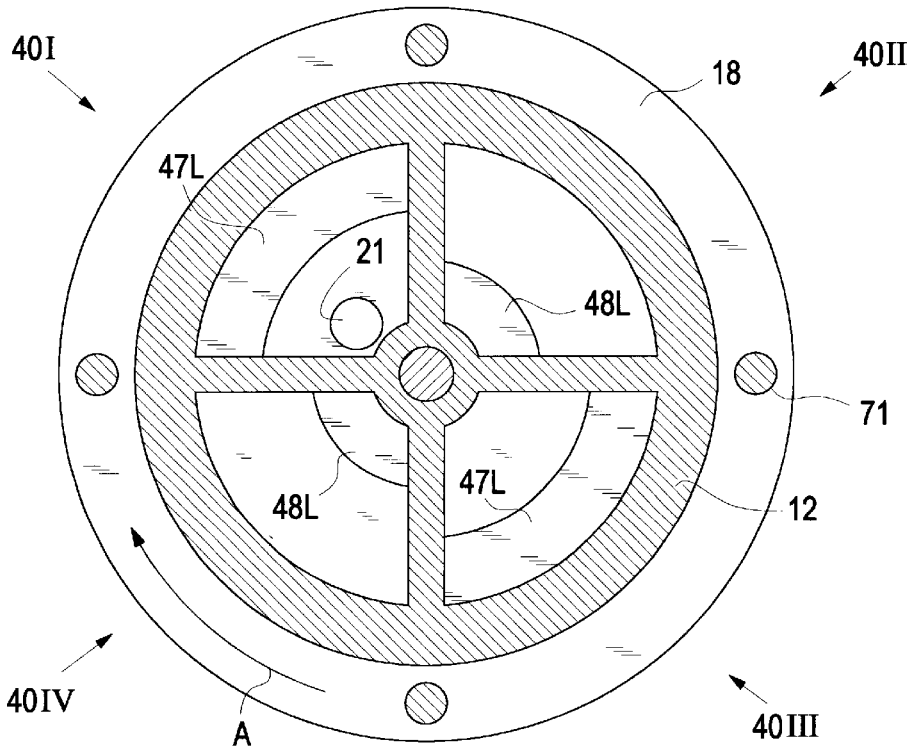
FIG. 4 is a cross-sectional view taken along line 4—4 in FIG. 1 showing an exemplary alignment of features on the lower faceplate as viewed from inside the exemplary rotor.

Referring now to FIGS. 1–6, there is shown an engine 10 (shown schematically in FIG. 1) comprising a rotor 12 (shown in top view in FIG. 2 and in perspective in FIG. 5) adapted to rotate on rotor shaft 14 about axis X between an upper faceplate 16 (shown in detail in FIG. 3) and a lower faceplate 18 (shown in detail in FIG. 4). Internal combustion within rotor 12 creates expanding gases that discharge from rotor 12 through exhaust port 19 in upper faceplate 16 or exhaust port 21 in lower faceplate 18 and flow into upper power cylinder 20 or lower power cylinder 22, respectively, through a connecting pipe 17. It should be noted that the labels "upper" and "lower" are used herein only to facilitate the discussion of FIG. 1 as illustrated, and by no means limits the invention to a vertical configuration of the engine as shown in FIG. 1 or to any particular configuration of the rotor and faceplates. The alternating discharge of expanding gas into power cylinders 20 and 22 moves pistons 24 and 25, respectively, which rotates crankshaft 26. Crankshaft 26 and rotor shaft 14 are connected by a belt and sheave transmission 28 in a ratio of 1:2 such that for every 2 rotations of crankshaft 26, belt 29 rotates rotor shaft 14 once. Thus, sheave 30 on the end of crankshaft 26 has one half the circumference of sheave 32 on the end of rotor shaft 14. Accordingly, each set of two cams 64 is circumferentially spaced 180 degrees apart, and the set serving upper power cylinder 20 is oriented 90 degrees off circumferentially from the set of cams 64 serving lower power cylinder 22, as shown in FIG. 1.

Referring now to FIG. 2, rotor 12 as shown herein has four compartments 40. Each compartment 40 within rotor 12 is defined circumferentially by the inner surface 41 of cylindrical sidewall 42 and the inner surface 43 of hub 44 and defined radially by the inner surfaces 45 of radial vanes 46. Compartments 40 are open to faceplates 16 and 18 except for a pair of symmetrical upper and lower axial blocking plates 47U and 47L or 48U and 48L, as shown in perspective in FIG. 5. Each blocking plate comprises a relatively thin sheet of metal that extends parallel to and in contact with faceplate 16 or 18. Axial blocking plates 47U and 47L extend between radial vanes 46 radially inward from sidewall 42 whereas blocking plates 48U and 48L extend radially outward from hub 44. The compartments alternate such that each compartment having a pair of upper and lower blocking plates 47U and 47L is adjacent to a compartment having a pair of upper and lower blocking plates 48U and 48L, and so on. In the four compartment rotor 12 as shown in FIG. 2, this results in compartments 40I and 40III, both of which have blocking plates 47U and 47L, being 180 degrees opposite one another, and compartments 40II and 40IV, both of which have blocking plates 48U and 48L, also being 180 degrees opposite one another.

The radial extension of the blocking plates from hub 44 or sidewall 42 is sufficient such that the blocking plates block the exhaust port on one of the opposing faceplates to prevent gas discharge from the compartment through that exhaust port. For example, blocking plates 47U extend radially inward a sufficient distance to block exhaust port 19 on upper faceplate 16. FIG. 3 shows upper faceplate 16 with exhaust port 19 aligned with blocking plate 47U such that it is blocked. Similarly, blocking plates 48L extend radially outward a sufficient distance to block exhaust port 21 on lower faceplate 18. FIG. 4 shows lower faceplate 18 with the exhaust port 21 in an unblocked position with rotor 12 rotated 90 degrees from a position in which the exhaust port is blocked. Although only upper blocking plate 47U is required to block exhaust port 19 on upper faceplate 16 and lower blocking plate 48L is required to block exhaust port 21 on lower faceplate 18, the matching lower blocking plate 47L and upper blocking plate 48U are present to provide balanced symmetry to rotor 12.

This balanced symmetry, in addition to providing rotational balance, is also beneficial because it equalizes the forces acting on the rotor when the fuel/air mixture in compartment 40 of rotor 12 ignites. As the compartment pressurizes, no resultant axial force is exerted on the rotor because the exposed surface area of the blocking plates is the same on both the upper and lower sides. Thus, there is no reaction force pushing the rotor in either axial direction to create elevated wear or friction between rotor 12 and faceplates 16 or 18. Similarly, because sidewall 42 and hub 44 that create the outer and inner circumferential boundaries of compartment 40, respectively, are both integral parts of rotor 12, there is no reaction force that pushes rotor 12 in any particular radial direction. Because there is no radial force exerted on rotor 12, the present invention eliminates the friction and wear in a standard rotary engine where the rotor pushes against the fixed cylindrical walls of the combustion chamber.

Figure 5:
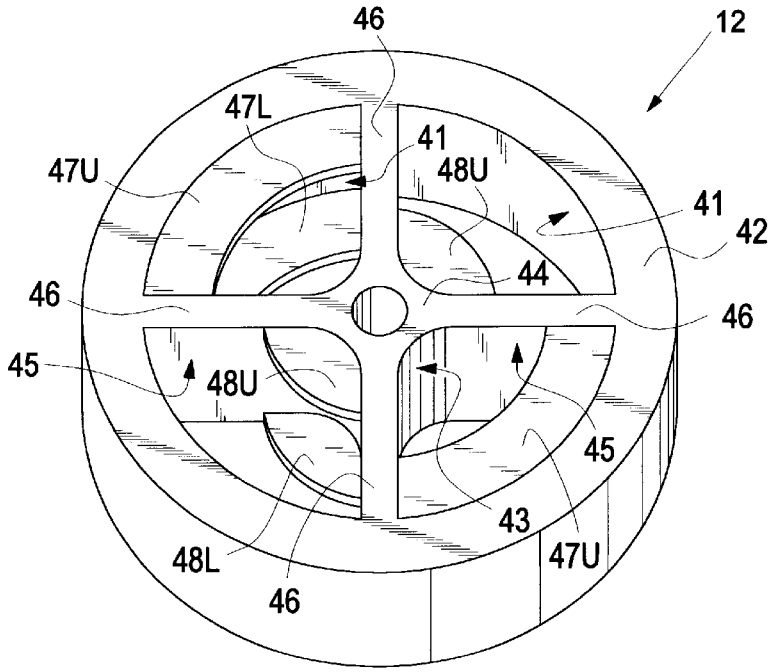
FIG. 5 is a perspective view of an exemplary rotor.

Cylinders 20 and 22, as shown in FIG. 1, are mounted so that they receive the exhaust gas from the compartments of rotor 12. Thus, compartments 40II and 40IV release exhaust to cylinder 20 and compartments 40I and 40III release exhaust to cylinder 22. The combustion process within each compartment requires fuel, air, and an ignition spark, and may further include cooling water that is added after ignition. Thus, in addition to the exhaust ports, one or both of faceplates 16 and 18 also comprise a fuel or air/fuel mixture intake port 50, a spark plug port 52, and optionally, a cooling water port 54. Therefore, referring to FIG. 3 for example, the rotation of rotor 12 in the direction of arrow A means that as each compartment (40II or 40IV) approaches exhaust port 19, the fuel or air/fuel mixture is added through intake port 50, it is ignited by a spark from the spark plug (not shown) through port 52, and cooling water is optionally injected into the hot gases through port 54, instantly flashing to steam. The cooling water may also contain a small amount of antifreeze, preferably a non-toxic antifreeze, such as but not limited to, glycerine or ethanol. It may be desirable to orient the injection of the fuel or air/fuel mixture through port 50 and the water through port 54, or both, in the same direction as the rotation of rotor 12 so that the injected substance already has some velocity in the same direction as the rotation of the rotor when the injected substance enters the compartment. When the mixture of combustion gas and steam reaches exhaust port 19, it exits the compartment into cylinder 20, where it pushes piston 24 in the direction of arrow B. As rotor 12 continues its rotation past exhaust port 19, it fully depressurizes at vent 56, and then approaches ports 50, 52, and 54 again for another cycle.

Where the blocking plates are oriented with one set against hub 44, such as blocking plates 48L and 48U as shown in FIG. 5, and one set against the sidewall 42, such as blocking plates 47L and 47U in FIG. 5, ports 50, 52, and 54 are located radially such that they are not blocked by either set of blocking plates. Thus, a single set of ports may feed all of the compartments 40I–40IV shown in FIG. 2. Although it is desirable for the sets of blocking plates to be located against the hub and sidewall, respectively, as shown in FIGS. 2–5, other blocking plate locations may be chosen. Thus, the location of ports 50, 52, and 54 are radially located wherever they are not blocked by the blocking plates. In an alternative embodiment, there may be one set of ports on the upper faceplate 16 and another set of ports on the lower faceplate 18, in which case each set may be located so that they can only inject into one of the pairs of compartments adapted to exhaust into a single cylinder.

In the configuration shown in FIG. 3, during the time that compartment 40IV is charged with fuel/air, ignited, and optionally, is injected with cooling water, compartment 40I discharges through exhaust port 21, and compartment 40II vents through vent 56. Thus, while piston 24 in cylinder 20 is moving in the direction of arrow B, piston 25 in cylinder 22 is moving in the direction of arrow C. The gas in cylinder 22 is expelled through valve 60.

Figure 6:
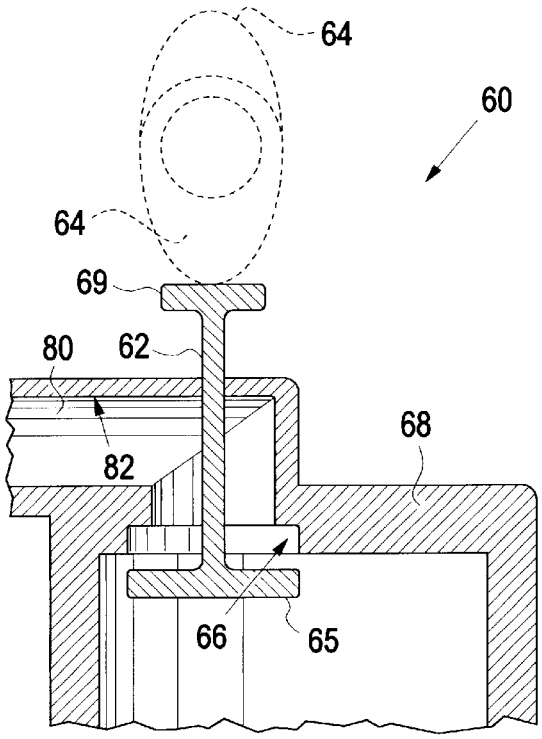
FIG. 6 is a cross-sectional view of an exemplary exhaust valve.

Valve 60, shown in detail in FIG. 6, is adapted to open when valve stem 62 is depressed in the direction of arrow B and is further adapted to automatically close whenever the pressure in the cylinder exceeds atmospheric pressure. If the atmospheric pressure is greater than the pressure in the cylinder, however, the atmospheric pressure will cause the valve to open to relieve the vacuum in the cylinder. This feature is important because the volume of the cylinder can be optimized to take advantage of as much power of the expanding gases as is reasonably possible. In a standard engine, the cylinder volume is typically designed such that the expanding combustion gas in the cylinder is always expelled under pressure, even for the lowest throttle setting (the minimum amount of fuel provided by the fuel regulator). This means that under routine operation, the combustion gas is expelled from the cylinder while there is still energy (pressure) left in the gas that could have been extracted. The release of still-pressurized gas results in a loss of efficiency. Some loss in efficiency is inevitable.

In the present invention, however, the size of the cylinder can be optimized so that at full throttle the gases are discharged at a lower pressure than for similar engines. This may mean that at lowest throttle settings, the gas pressure may be insufficient to move the piston to its fully extended position. Because the crankshaft is typically attached to a flywheel or some other mechanism that provides inertial momentum, the piston still fully extends in the cylinder, but the flywheel, rather than the combustion gas, provides the power to move the piston, causing the pressure in the cylinder to drop below atmospheric pressure. Without the ability of the valve to open when the cylinder pressure drops below atmospheric pressure, the vacuum in the cylinder would act against the inertia of the flywheel and quickly sap momentum from the engine. With the vacuum-relieving valve design of the present invention, the pressure in the cylinder is equalized with atmospheric pressure instead of developing vacuum, so the flywheel is able to keep the engine running for a longer period of time before the engine stops or before the fuel intake has to be increased so that the combustion gas can again complete the piston stroke under pressure. This essentially allows the engine to "coast" for extended periods of time. The duration of such "coasting" operation, of course, cannot extend indefinitely, but can conserve fuel for limited amounts of time. The vacuum-relieving valve and the greater extraction of energy from the combustion gas that the valve allows under full and intermediate throttle settings that fully stroke the piston, help maximize the overall efficiency of the engine.

When the piston is full of expanding gas, the gas pressure automatically closes valve 60.

During the exhaust cycle of the cylinder, however, one of the cams 64 on rotor shaft 14 depresses valve stem 62 to forcibly open valve 60 so that the exhaust gas can escape. FIG. 6 shows a close-up of valve 60 and a corresponding valve plug 65 and valve seat 66 in wall 68 of a cylinder, such as cylinder 20 or 22. A plurality of exhaust valves 60 may empty into a common exhaust pipe 80, in which case valve stem 62 may protrude through wall 82 of the exhaust pipe so that it can be depressed by cams 64. Valve stem 62 may have a stop 69 that prevents over-depression of the valve stem. In general, the design of cylinder valves is known in the art. Typically, however, the cylinder is biased closed by a spring, with a cam used for opening the valve during the discharge cycle similar to in the present invention. The critical difference in an embodiment of the present invention, however, is that valve 60 has no spring bias, so the pressure in the cylinder is the only force that closes the valve.

It should be understood that although shown with four compartments and two cylinders in FIGS. 1–5, rotor 12 may have fewer or more compartments and/or cylinders, with the transmission ratio between crankshaft 26 and rotor 14 adjusted accordingly. For example, a rotor having only two compartments may comprise a compartment having blocking plates 47U and 47L located 180 degrees across from a compartment having blocking plates 48U and 48L, so that the two-compartment rotor can still serve two cylinders. In such case, the gear ratio between crankshaft 26 and rotor shaft 14 need only be 1:1 and therefore a single shaft can serve as both the crankshaft and the rotor shaft.

Although shown with a belt and sheave transmission in FIG. 1, engine 10 may have any transmission means known in the art, including but not limited to, a gear transmission, a viscously-coupled transmission, or a chain drive.

The fuel used may be any combustible gas or liquid known in the art that does not require compression as part of the engine stroke. The air/fuel mixture may be at atmospheric pressure, or may be supercharged by compressing the mixture so that a greater amount of fuel can be burnt in each chamber, providing more power. Air vent 56 may be located on only one or on both faceplates 16 and 18. Air vent 56 may be a wedge-shaped vent having the same dimensions as compartments 40, may be a smaller wedge shape, or may have another geometric shape. Where air vents 56 are located on both faceplates, a fan may be mounted with airflow directed into the air vent such that the fan helps to evacuate each compartment by blowing air in one air vent, through the compartment, and out the other air vent. Although shown with a common air/fuel intake, such as may be fed by a carburetor as is commonly known in the art, each faceplate may comprise separate air and fuel intakes. The fuel intake may comprise fuel injection, such as for a liquid fuel, or may run directly on gas pressure, such as for an engine powered by a gaseous fuel. The air intake may comprise atmospheric air or pressurized air, pressurized air again providing more power. Where atmospheric air is used, air vent 56 may also serve as the air intake. Although shown in FIGS. 3 and 4 with a set of fuel or air/fuel intake port 50, ignition source port 52, vent 56, and optional cooling water port 54 on upper faceplate 16 only, all of the above ports may instead be located on lower faceplate 18. In an alternative embodiment, each faceplate may comprise a set of ports.

Rotor 12 is depicted schematically in FIGS. 2–4 with hub 44 having a discretely cylindrical shape whereas in FIG. 5 the hub is shown as being merely an intersection of radial vanes 45. It should be understood that the various features of the rotor, such as for example, the thicknesses of the sidewall and radial vanes, the shape and size of the hub, and the surface configuration where rotor 12 interfaces with upper and lower faceplates 16 and 18, may be varied as desired. The design of rotor 12 may be optimized to, for example, maximize strength, minimize weight, minimize friction and wear against faceplates 16 and 18, or otherwise maximize or minimize certain characteristics without departing from the scope of this invention.

Figure 7:
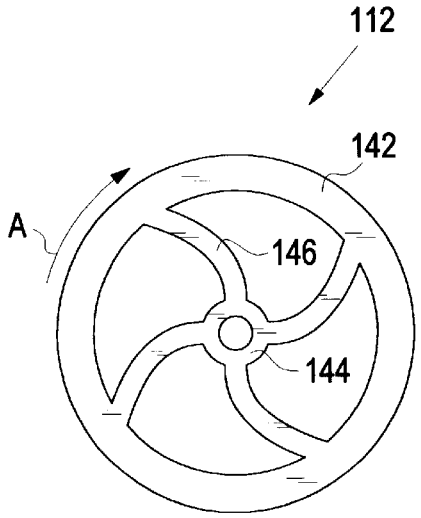
FIG. 7 is a top view of an exemplary rotor having curved vanes.

Referring now to FIG. 7, it may be desirable for rotor 112 to have curved radial vanes 146. The vanes may curve or bend in either direction from hub 144 to circumferential wall 142 relative to the direction of rotation along arrow A, such that the connection of the vane to the hub either leads (as is shown in FIG. 7) or lags the connection of the vane to the circumferential wall. Such curvature may be beneficial to avoid liquid cooling water or injected fuel/air mixture from hitting the vanes of the rotor before such liquid completely evaporates. It should be noted that any of a number of vane geometries, including vanes that have a curved configuration from faceplate-to-faceplate, may be constructed as desired to optimize performance for specific applications. In particular, where the blocking plates are configured such that ports 50, 52, and 54 are not centrally located, but rather located closer to hub 144 or sidewall 142, curvature of vanes 146 may be beneficial. The configuration shown in FIG. 7 thus may be more beneficial where the ports 50, 52, and 54 are located closer to the hub. Given a rotational direction along arrow A with intake ports closer to the sidewall, it may be more desirable for vanes 146 to curve in the opposite direction (with the sidewall connection leading the hub connection). In general, the curvature may be designed so that the connection of vane 146 to the wall (sidewall 142 or hub 144) closest to ports 50, 52, and 54 rotationally leads the connection of the vane to the wall furthest from the ports. Similarly, therefore, with ports 50, 52, and 54 located centrally between sidewall 142 and hub 144, it may be desirable for the curvature of the vanes to be such that the middle of vane 45 between the sidewall and the hub rotationally leads both connections of the vane to the respective walls.

As is known in the art generally, upper faceplate 16 and lower faceplate 18 are connected together by a plurality of connecting rods 70 (shown in FIG. 1) which may have threaded ends (not shown) that extend through holes 71 in the faceplates (shown in FIGS. 3 and 4) and are fastened, for example, with nuts (not shown). Furthermore, each contact surface of rotor 12 that contacts upper faceplate 16 or lower faceplate 18 comprises a seal 72 (shown in FIG. 1) capable of maintaining gas pressure within each compartment 47 without allowing any gas to escape between sidewall 42 and the upper or lower faceplates or between vanes 46 and the upper or lower faceplates. Such a seal typically comprises a polished metal surface. Brass, for example, is well known in automotive applications for its wear resistance, but any suitable sealing material may be used. The mating surfaces of upper faceplate 16 and lower faceplate 18 with which seals 72 interface are typically similarly polished. The contact surfaces of seal 72 and faceplates 16 and 18 must be flat within narrow tolerances sufficient to maintain the desired seal. Typical such tolerances are well known in the automotive art. Seal 72, as well as the contact surfaces of faceplates 16 and 18, are typically discrete elements that are specially adapted for sealing, and that are attached to whatever material comprises rotor 12 or the faceplates, potentially making these sealing surface components independently replaceable instead of having to replace the entire rotor or faceplate if the sealing surface wears. In an alternative embodiment, the entire rotor or the entire faceplate may each be made of a homogenous material throughout, with the sealing surface being merely a highly polished surface to the desired tolerances. The contact surface then is also lubricated with standard lubricants, such as motor oil, to reduce frictional wear, as is wellknown known in the art. Such lubricants may be introduced in a mixture with the fuel or via a separate oil addition port (not shown).

Those skilled in the art having the benefit of the present teachings as set forth herein above may effect numerous modifications thereto. These modifications may be construed as falling within the scope of the present invention as set forth in the appended claims.

What is claimed:

1. An internal combustion engine comprising a) a cylindrical rotor rotatably mounted between opposing faceplates, at least one of the faceplates comprising a gas exhaust port, the rotor adapted to rotate about a rotor axis on a shaft, the rotor comprising a plurality of fixed-volume fuel ignition compartments, each fuel ignition compartment defined circumferentially by a cylindrical sidewall of the rotor and by a central hub and defined radially by radial vanes of the rotor each connected to the sidewall at one end and to the central hub at an opposite end, each fuel ignition compartment enclosed axially by the opposing faceplates; and b) a power cylinder in direct gas communication with the gas exhaust port, the power cylinder comprising a reciprocating piston therein and an exhaust valve.

2. The engine of claim 1 wherein at least one of the faceplates further comprises at least one fuel/air intake, at least one vent, and at least one ignition source.

3. The engine of claim 2 wherein the fuel/air intake is attached to a source of compressed fuel/air.

4. The engine of claim 2 wherein at least one of the faceplates further comprises at least one cooling water intake.

5. The engine of claim 1 wherein the rotor is connected to a rotor shaft that rotates about the rotor axis and in which the power cylinder is connected to a crankshaft, the crankshaft and the rotor shaft connected by a transmission that provides a 2:1 ratio of crankshaft rotation to rotor shaft rotation.

6. The engine of claim 1 comprising a plurality of power cylinders.

7. The engine of claim 6 wherein each fuel ignition compartment is adapted to discharge gas into less than all of the plurality of cylinders.

8. The engine of claim 1 wherein the rotor vanes are curved.

9. An internal combustion engine comprising a) a cylindrical rotor rotatably mounted between opposing faceplates, at least one of the faceplates comprising a gas exhaust port, the rotor adapted to rotate about a rotor axis, the rotor comprising a plurality of fixed-volume fuel ignition compartments, each fuel ignition compartment defined circumferentially by a cylindrical sidewall of the rotor and by a central hub and defined radially by radial vanes of the rotor each connected to the sidewall at one end and to the central hub at an opposite end, each fuel ignition compartment enclosed axially by the opposing faceplates; and b) a power cylinder in direct gas communication with the gas exhaust port, the power cylinder comprising a reciprocating piston therein and an exhaust valve adapted to automatically close when gas pressure inside the power cylinder exceeds atmospheric pressure and to automatically open when the atmospheric pressure exceeds the gas pressure inside the power cylinder.

10. The engine of claim 9 wherein the exhaust valve further comprises a valve stem and in which the rotor is connected to a rotor shaft adapted to rotate about the rotor axis, the rotor shaft further comprising at least one cam adapted to actuate the valve stem to forceably open the power cylinder exhaust valve during an exhaust cycle of the power cylinder.

11. An internal combustion engine comprising a) a cylindrical rotor rotatably mounted between opposing faceplates, at least one of the faceplates comprising a gas exhaust port, the rotor adapted to rotate about a rotor axis, the rotor comprising a plurality of fixed-volume fuel ignition compartments, each fuel ignition compartment defined circumferentially by a cylindrical sidewall of the rotor and by a central hub and defined radially by radial vanes of the rotor each connected to the sidewall at one end and to the central hub at an opposite end, each fuel ignition compartment enclosed axially by the opposing faceplates; and b) a plurality of power cylinders in direct gas communication with the gas exhaust port, each power cylinder comprising a reciprocating piston therein and an exhaust valve, wherein each fuel ignition compartment in the rotor is adapted to discharge gas into a first cylinder that is rotationally adjacent to a fuel ignition compartment adapted to discharge gas into a second cylinder.

12. An internal combustion engine comprising a) a cylindrical rotor rotatably mounted between opposing faceplates, at least one of the faceplates comprising a gas exhaust port, the rotor adapted to rotate about a rotor axis, the rotor comprising a plurality of fixed-volume fuel ignition compartments, each fuel ignition compartment defined circumferentially by a cylindrical sidewall of the rotor and by a central hub and defined radially by radial vanes of the rotor each connected to the sidewall at one end and to the central hub at an opposite end, each fuel ignition compartment enclosed axially by the opposing faceplates; and b) two power cylinders in direct gas communication with the gas exhaust port, each power cylinder comprising a reciprocating piston therein and an exhaust valve, wherein each fuel ignition compartment is adapted to discharge into only one of the two cylinders.

13. An internal combustion engine comprising a) a cylindrical rotor rotatably mounted between opposing faceplates, at least one of the faceplates comprising a gas exhaust port, the rotor adapted to rotate about a rotor axis, the rotor comprising a plurality of fixed-volume fuel ignition compartments, each fuel ignition compartment defined circumferentially by a cylindrical sidewall of the rotor and by a central hub and defined radially by radial vanes of the rotor each connected to the sidewall at one end and to the central hub at an opposite end, each fuel ignition compartment enclosed axially by the opposing faceplates; and b) two power cylinders in direct gas communication with the gas exhaust port, each power cylinder comprising a reciprocating piston therein and an exhaust valve, one cylinder located on each axial side of the rotor, wherein each faceplate comprises a gas exhaust port and each cylinder is in gas communication with a respective one of the exhaust ports.

14. The engine of claim 13 wherein the exhaust port on one faceplate is radially more distant from the rotor axis than the other exhaust port.

15. The engine of claim 14 wherein each fuel ignition compartment further comprises a pair of symmetrical axial blocking plates extending between the radial vanes and parallel to and in contact with the faceplates, the blocking plates sufficiently extending radially outward from the hub or radially inward from the rotor circumferential sidewall to block the exhaust port on one of the opposing faceplates to prevent gas discharge from the fuel ignition compartment through the exhaust port.

16. The engine of claim 15 wherein the rotor comprises four fuel ignition compartments, two identical fuel ignition compartments each having a pair of axial blocking plates extending radially inward and two identical fuel ignition compartments each having a pair of axial blocking plates extending radially outward, each fuel ignition compartment positioned on the rotor 180-degrees opposite the identical fuel ignition compartment.

17. The engine of claim 16 wherein the rotor is connected to a rotor shaft that rotates about the rotor axis and in which each power cylinder is connected a crankshaft, the crankshaft and the rotor shaft connected by a transmission that provides a 2:1 ratio of crankshaft rotation to rotor shaft rotation.

18. The engine of claim 17 wherein the transmission comprises a belt and sheave transmission.

19. An internal combustion engine comprising a) a cylindrical rotor rotatably mounted between opposing faceplates, at least one of the faceplates comprising a gas exhaust port, at least one vent, at least one ignition source, and at least one fuel/air intake, the fuel/air intake connected to a fuel regulator adapted to provide a first, relatively large quantity of fuel at a maximum throttle and a second, relatively small quantity of fuel at a minimum throttle, the rotor adapted to rotate about a rotor axis and comprising a plurality of fixed-volume fuel ignition compartments, each fuel ignition compartment defined circumferentially by a cylindrical sidewall of the rotor and by a central hub and defined radially by radial vanes of the rotor each connected to the sidewall at one end and to the central hub at an opposite end, each fuel ignition compartment enclosed axially by the opposing faceplates; and b) a plurality of power cylinders in direct gas communication with the gas exhaust port, each power cylinder comprising a reciprocating piston therein and an exhaust valve, the power cylinder having a maximum volume with the reciprocating piston in a fully extended position that is greater than a volume of combustion gas at atmospheric pressure generated by ignition of the second quantity of fuel mixed with a corresponding ratio of air.

20. An internal combustion engine rotor adapted to rotate about a rotor axis on a shaft, the rotor having opposite axial sides in contact with opposite faceplates and comprising a plurality of fixed-volume volume fuel ignition compartments, each fuel ignition compartment defined circumferentially by a cylindrical sidewall and a central hub and defined radially by radial vanes each connected to the sidewall at one end and connected to the central hub at the opposite end, the opposite axial sides of each fuel ignition compartment being substantially open.

21. An internal combustion engine rotor adapted to rotate about a rotor axis and having opposite axial sides in contact with opposite faceplates, the rotor comprising a plurality of fixed-volume fuel ignition compartments, each fuel ignition compartment defined circumferentially by a cylindrical sidewall and a central hub and defined radially by radial vanes each connected to the sidewall at one end and connected to the central hub at the opposite end, the opposite axial sides of each fuel ignition compartment being substantially open, each fuel ignition compartment further comprising a pair of symmetrical axial blocking plates partially closing each open axial side, the respective blocking plates extending between the radial vanes and sufficiently extending radially outward from the hub or radially inward from the rotor circumferential sidewall to block gas flow out of the fuel ignition compartment into a gas exhaust port on one of the faceplates.

22. An internal combustion engine for driving a power shaft, the engine comprising a) a rotor shaft adapted to rotate about a rotor axis, the rotor shaft having at least two cams thereon;

b) a cylindrical rotor connected to a rotor shaft and comprising four fuel ignition compartments, each fuel ignition compartment defined circumferentially by a cylindrical sidewall of the rotor and by a central hub and defined radially by radial vanes of the rotor each connected to the sidewall at one end and to the central hub at an opposite end the cylindrical rotor, two of the fuel ignition compartments positioned 180-degrees apart comprising a pair of symmetrical axial blocking plates extending between the radial vanes and radially extending outward from the hub and two of the fuel ignition compartments positioned 180-degrees apart comprising a pair of symmetrical axial blocking plates extending between the radial vanes and radially extending radially inward from the rotor circumferential sidewall;

c) two opposing faceplates between which the rotor is mounted and that enclose the rotor fuel ignition compartments axially, each faceplate comprising a gas exhaust port, the exhaust port on one faceplate being radially more distant from the rotor axis than the other exhaust port, the exhaust ports being positioned such that the the blocking plates in two of the fuel ignition compartments block each port from receiving gas discharge from those fuel ignition compartments;

d) two power cylinders, each in direct gas communication with one of the gas exhaust ports, each power cylinder comprising a reciprocating piston therein and an exhaust valve adapted to automatically close when gas pressure inside the power cylinder exceeds atmospheric pressure and to automatically open when the atmospheric pressure exceeds the gas pressure inside the power cylinder, each exhaust valve further comprising a valve stem adapted to be actuated by one of the rotor shaft cams to forceably open the exhaust valve during an exhaust cycle of the power cylinder; and a crankshaft coupled to the rotor shaft by a transmission and connected to power cylinders such that movement of the power cylinder reciprocating pistons turns the crankshaft.

* * * * *